US011084160B2

(12) United States Patent
Draganis et al.

(10) Patent No.: US 11,084,160 B2
(45) Date of Patent: Aug. 10, 2021

(54) HAND-HELD POWER TOOL

(71) Applicant: Hilti Aktiengesellschaft, Schaan (LI)

(72) Inventors: Antonios Draganis, Bad Woerishofen (DE); Florian Mayr, Kaufbeuren (DE); Helmut Burger, Unterdiessen (DE); Georg Braml, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 256 days.

(21) Appl. No.: 15/745,404

(22) PCT Filed: Jul. 12, 2016

(86) PCT No.: PCT/EP2016/066520
§ 371 (c)(1),
(2) Date: Jan. 16, 2018

(87) PCT Pub. No.: WO2017/012921
PCT Pub. Date: Jan. 26, 2017

(65) Prior Publication Data

US 2018/0207784 A1 Jul. 26, 2018

(30) Foreign Application Priority Data

Jul. 17, 2015 (EP) ..... 15177216

(51) Int. Cl.
*B25F 5/02* (2006.01)
*B25F 5/00* (2006.01)
*B25B 21/00* (2006.01)

(52) U.S. Cl.
CPC ..... *B25F 5/02* (2013.01); *B25F 5/00* (2013.01); *B25B 21/007* (2013.01)

(58) Field of Classification Search
CPC ..... B25B 5/02; B25B 21/007; H01H 9/0214; H01H 21/00; H01H 2223/04
(Continued)

(56) References Cited

U.S. PATENT DOCUMENTS 1,762,202 A * 6/1930 Sweet ..... H01H 21/10 200/522
3,519,089 A * 7/1970 Schnettler ..... B23B 45/001 173/170
(Continued)

FOREIGN PATENT DOCUMENTS

CN 101276695 A 10/2008
CN 101844345 A 9/2010
(Continued)

OTHER PUBLICATIONS

PCT/EP2016/066520, International Search Report (PCT/ISA/210) dated Aug. 12, 2016, with partial English translation, enclosing Written Opinion of the International Searching Authority (PCT/ISA/237) (Fourteen (14) pages).

*Primary Examiner* — Thanh K Truong
*Assistant Examiner* — David G Shutty
(74) *Attorney, Agent, or Firm* — Crowell & Moring LLP

(57) ABSTRACT

A hand-held power tool has a tool holder for holding a tool, an electric motor for driving the tool holder, and a handle for holding and guiding the hand-held power tool. A button has a button housing, a pin that can be moved on an actuation axis, and an electric slider which is connected to the pin and which slides on an electric slider track. The button housing is suspended in the handle in such a way that the button housing can be pivoted about a pivot axis perpendicular to the actuation axis.

6 Claims, 2 Drawing Sheets

(58) Field of Classification Search
USPC ..... 173/170; 200/522, 523, 530, 531, 535
See application file for complete search history.

(56) References Cited

U.S. PATENT DOCUMENTS

| | | | | |
|---|---|---|---|---|
| 4,667,119 | A * | 5/1987 | Holmes | H01H 13/08 307/326 |
| 5,835,351 | A * | 11/1998 | Ulanski | H02P 25/14 361/704 |
| 6,555,773 | B1 * | 4/2003 | Broghammer | H01H 3/20 200/321 |
| 6,749,028 | B1 * | 6/2004 | Chan | B25F 5/00 173/170 |
| 6,766,868 | B2 * | 7/2004 | Frauhammer | B25D 16/006 173/162.2 |
| 7,076,838 | B2 * | 7/2006 | Meixner | B25D 17/043 16/430 |
| 7,557,321 | B2 | 7/2009 | Arataki et al. | |
| 7,886,838 | B2 * | 2/2011 | Hahn | B25D 17/043 16/110.1 |
| 7,987,921 | B2 * | 8/2011 | Hahn | B25D 17/043 173/162.1 |
| 8,286,724 | B2 | 10/2012 | Furusawa et al. | |
| 8,550,181 | B2 * | 10/2013 | Kobayashi | H01H 9/047 173/217 |
| 9,004,191 | B2 * | 4/2015 | Muller | B25F 5/006 173/162.2 |
| 2008/0314721 | A1 * | 12/2008 | Arataki | H01H 9/061 200/17 B |
| 2009/0223690 | A1 * | 9/2009 | Sugimoto | B25B 21/026 173/48 |
| 2010/0236801 | A1 * | 9/2010 | Furusawa | B25D 11/10 173/47 |
| 2012/0006573 | A1 * | 1/2012 | Sugimoto | B25F 5/001 173/104 |
| 2012/0061216 | A1 * | 3/2012 | Kawakami | B25F 5/02 200/302.2 |
| 2013/0206434 | A1 * | 8/2013 | Braun | B25F 5/00 173/2 |
| 2014/0054147 | A1 * | 2/2014 | Yang | H01H 3/06 200/335 |
| 2015/0113815 | A1 * | 4/2015 | McRoberts | B23D 51/01 30/392 |
| 2015/0115857 | A1 * | 4/2015 | Sergyeyenko | B25F 5/02 318/504 |
| 2016/0358728 | A1 | 12/2016 | Hozumi et al. | |

FOREIGN PATENT DOCUMENTS

| | | | |
|---|---|---|---|
| CN | 102129923 | A | 7/2011 |
| CN | 202268266 | U | 6/2012 |
| CN | 202540269 | U | 11/2012 |
| CN | 103337396 | A | 10/2013 |
| CN | 203895329 | U | 10/2014 |
| DE | 199 13 712 | A1 | 10/1999 |
| EP | 1 975 956 | A2 | 10/2008 |
| WO | WO 02/06015 | A1 | 1/2002 |

* cited by examiner

HAND-HELD POWER TOOL

This application claims the priority of International Application No. PCT/EP2016/066520, filed Jul. 12, 2016, and European Patent Document No. 15177216.7, filed Jul. 17, 2015, the disclosures of which are expressly incorporated by reference herein.

BACKGROUND AND SUMMARY OF THE INVENTION

The present invention relates to a hand-held power tool with a button for switching an electric motor on and off.

The hand-held power tool according to the invention has a tool holder for holding a tool, an electric motor for driving the tool holder and a handle for holding and guiding the hand-held power tool. A button has a button housing, a pin that can be moved on an actuation axis and an electric slider, which is connected to the pin, and which can be moved on an electric slider track along the actuation axis. The button housing is suspended in the handle in such a way that the button housing can be pivoted about a pivot axis perpendicular to the actuation axis. The pin closes with the button housing in a dust-tight manner in order to prevent dust entering the button housing. The dust-tight closure is not very mechanically resilient. The button housing can advantageously align in a pivoting manner such that no transverse forces act on the pin and the stresses of the dust-tight closure are reduced.

One configuration envisages a button cover which is fastened with a pivot joint on the handle, an axis of rotation of the pivot joint being parallel and offset to the actuation axis.

The following description explains the invention based on exemplary embodiments and figures.

DETAILED DESCRIPTION OF THE DRAWINGS

Figure 1:
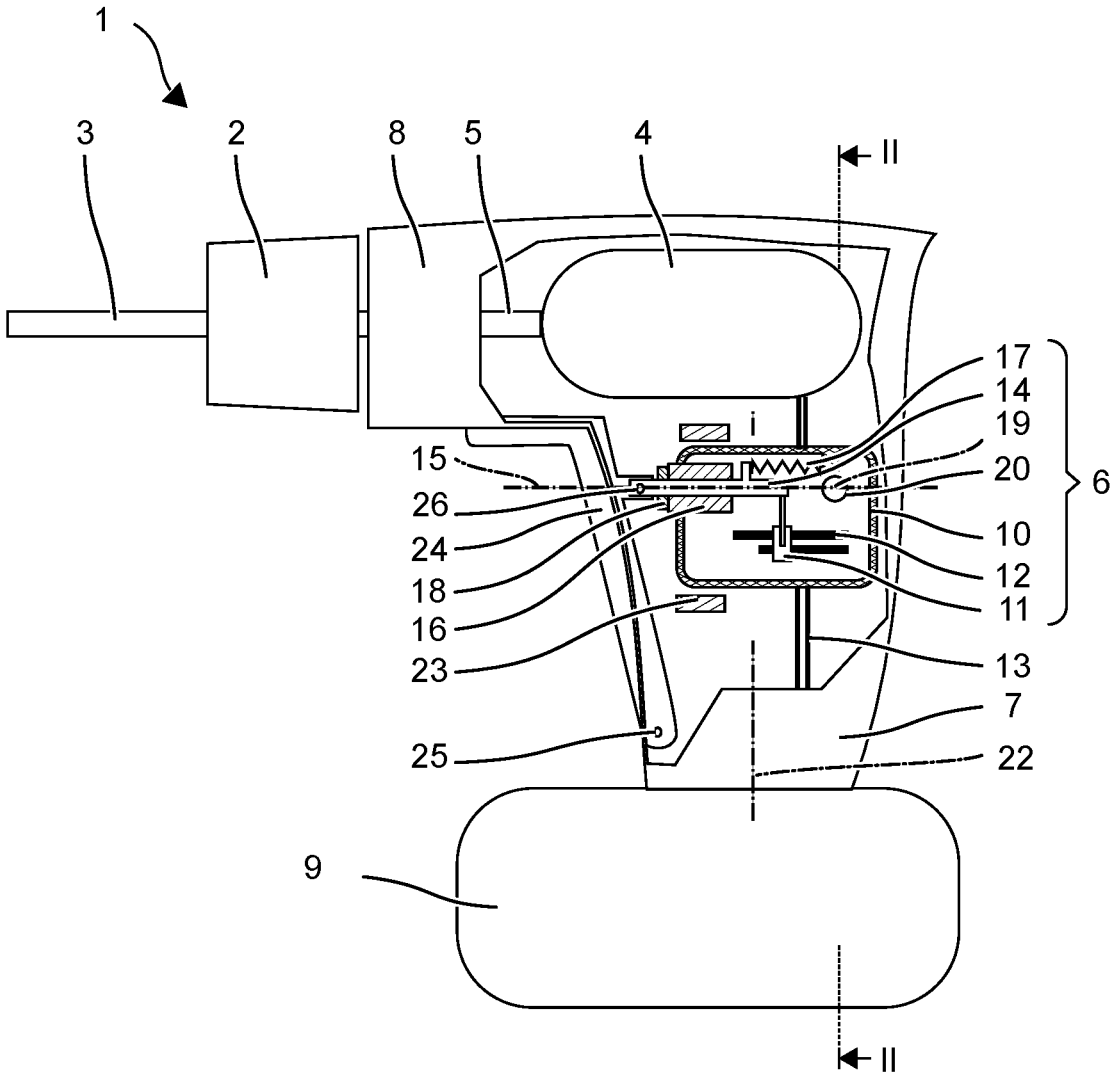
FIG. 1 illustrates a first embodiment of a drilling tool.
Figure 2:
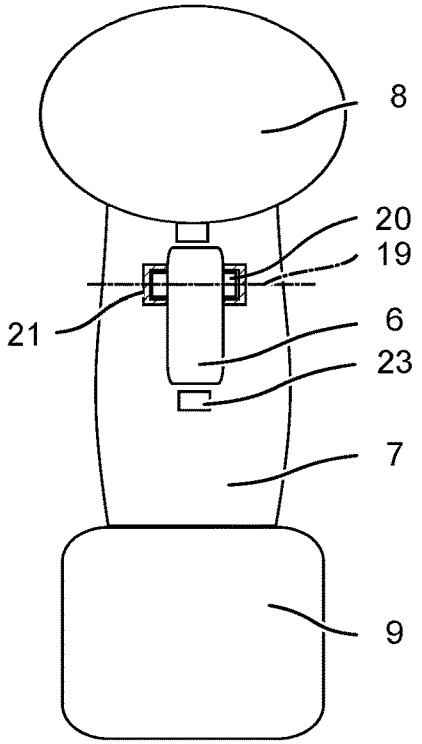
FIG. 2 is a section in the plane II-II of FIGS. 1 and 3.

Identical or functionally-identical elements are indicated with the same reference numerals in the figures, unless otherwise stated.

FIG. 1 shows a drilling tool 1 as an example of a hand-held power tool. The drilling tool 1 has a tool holder 2 in order to hold a tool 3 such as a drill, a screwdriver bit, etc. An electric motor 4 is coupled to the tool holder 2 via a drive rod 5 in order to drive the tool holder. The user can switch the electric motor 4 on and off via a button 6. The button 6 is arranged on a handle 7 which allows the user to hold and guide the drilling tool 1 during its operation. A power supply of the electric motor 4 can be provided by a mains-supplied power source or a battery pack 9 fastened on a tool housing 8 of the drilling tool 1.

The button 6 has a button housing 10. There is a movable electric slider 11 inside the button housing 10, the slider contacts two electric slider tracks 12 with one another as a function of its position. The electric slider 11 can for example contact only one of the slider tracks 12 in a base position, in a pressed-down position of the button 6, the slider 11 connects the slider tracks 12. The slider tracks are for example connected in a current path 13 or signal path. The electric motor 4 is supplied with power when the slider tracks 12 are connected to one another. Alternatively, a motor controller scans an electric connection of the slider tracks 12 and actuates the electric motor in correspondence therewith. The slider tracks 12 can be designed as resistance tracks. The position of the slider 11 and thus the depth by which the button 6 is actuated produces a clear resistance value, which the motor controller determines in order to adjust the rotational speed of the electric motor 4 as a function of the depth. The structure with the two slider tracks 12 serves for illustration purposes, other embodiments may comprise only one or even more than two slider tracks 12 which are contacted by one slider 11 or a plurality of sliders.

A pin 14 projects partially from the button housing 10. The pin 14 is arranged on the actuation axis 15 and is coaxially movably guided to the actuation axis. The actuation axis 15 is preferably parallel to the slider tracks 12. For example, the button housing 10 comprises a sleeve 16 that is coaxial to the actuation axis 15, in which the pin 14 slides along the actuation axis 15. The pin 14 can be pushed from a base position into the button housing 10 along the actuation axis 15. The pin 14 is preferably prestressed by a spring 17 into the base position. The slider 11 is arranged on the pin 14 and can thus be actuated by means of the pin 14 from outside of the button housing 10.

A sealing element 18 covers the pin 14 in order to reduce or prevent dust entering the button housing 10. The sealing element 18 can be arranged on the outside of the button housing 10 or on the inside of the button housing 10 as illustrated. Alternatively, the sealing element can also be arranged inside the sleeve 16 to guide the pin 14. The sealing element 18 has a central opening, through which the pin 14 is guided. A cross-section of the opening has roughly the same diameter as the pin 14. The sealing element 18 can be an O-ring or a bellows.

The button 6 is suspended in the handle 7 in such a way that the button housing can be pivoted about a pivot axis 19. The exemplary button housing 10 comprises two opposing cylindrical burls 20. The burls 20 are located in corresponding indentations 21 of the handle 7. The pivot axis 19 defined by the burls 20 is perpendicular on the actuation axis 15. The pivot axis 19 and the actuation axis 15 are preferably located in one plane, i.e., the pivot axis 19 intersects the actuation axis 15. The pin 14 of the button 6 projects from the handle 7, i.e., the actuation axis 15 is perpendicular or largely perpendicular to the gripping axis 22 of the handle 7. One or a plurality of stops 23 are preferably provided in the handle 7 which delimit the pivot angle of the button 6. The maximum pivot angle of the button 6 about the pivot axis 19 is preferably between 0.5 degrees and 5 degrees.

A button cover 24 covers the pin 14. The button cover 24 can be fastened on the handle 7 with a pivot joint 25. The pivot joint 25 is offset along the gripping axis 22 to the pin 14, i.e., to the actuation axis 15. The button cover 24 abuts on the pin 14. The user grasps the handle 7 and the button cover 24 with their hand and pivots the button cover 24 in the direction of the handle 7 by closing their hand, whereby the pin 14 is pushed into the button housing 10. The button cover 24 can be connected to the pin 14 by a stud 26. The stud 26 is preferably parallel to the pivot axis 19.

Figure 3:
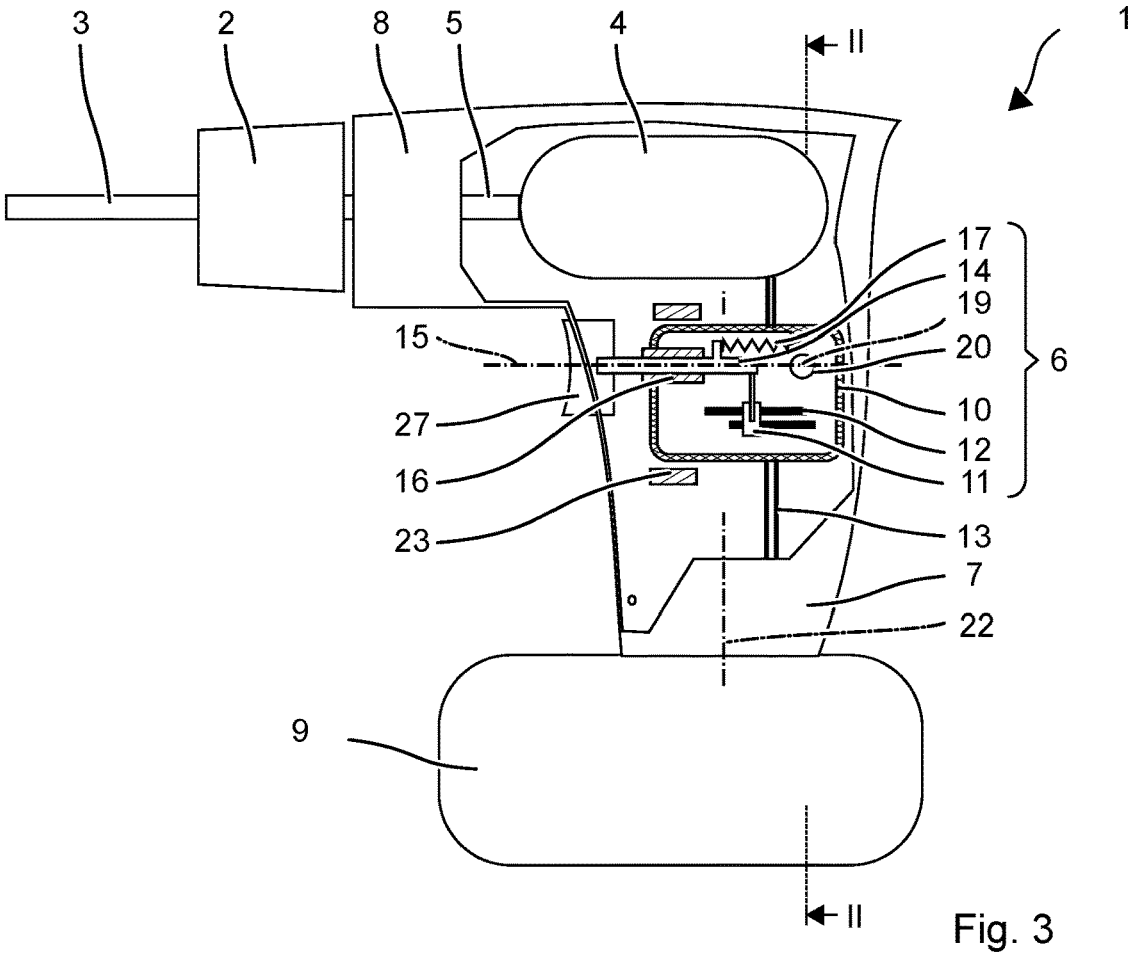
FIG. 3 illustrates a second embodiment of a drilling tool.

An alternative button cover 27 is rigidly placed on the pin 14 in FIG. 3. The button cover 27 is movable parallel to the actuation axis 15.

The drilling tool 1 is one example to illustrate the button 6, other hand-held power tools are electric screwdrivers, circular saws, jigsaws, angle grinders, electric chisels, etc.

The invention claimed is:

1. A hand-held power tool, comprising:

a tool holder;

an electric motor, wherein the tool holder is drivable by the electric motor;

a handle for holding and guiding the hand-held power tool; and a button for switching on the electric motor, wherein the button has a button housing and a pin that is movable on an actuation axis, wherein the pin is connected to a slider that is movable towards an electric slider track, wherein the button housing is suspended in the handle such that the button housing pivots about a pivot axis that is perpendicular to the actuation axis, wherein the button housing has two opposing cylindrical burls which are disposed in corresponding indentations of the handle, and wherein the pivot axis is defined by the two cylindrical burls.

2. The hand-held power tool according to claim 1 further comprising a button cover, wherein the button cover is disposed inclined to the pin and is fastened on the handle via a pivot joint and wherein an axis of rotation of the pivot joint is parallel and offset to the pivot axis.

3. The hand-held power tool according to claim 2, wherein the button cover is rotatably connected to the pin.

4. The hand-held power tool according to claim 2, wherein the button cover covers the pin.

5. The hand-held power tool according to claim 1, wherein the pivot axis and the actuation axis are in one plane.

6. The hand-held power tool according to claim 1 further comprising a button cover, wherein the button cover is mounted on the handle such that the button cover is movable parallel to the actuation axis and is disposed on the pin.

* * * * *